US006909225B1

(12) United States Patent
Irie et al.

(10) Patent No.: US 6,909,225 B1
(45) Date of Patent: Jun. 21, 2005

(54) GAS DISCHARGE DISPLAY DEVICE

(75) Inventors: Katsuya Irie, Kawasaki (JP); Fumihiro Namiki, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 107 days.

(21) Appl. No.: 09/722,697

(22) Filed: Nov. 28, 2000

(30) Foreign Application Priority Data

Dec. 7, 1999 (JP) ..... 11-347046

(51) Int. Cl.[7] ..... H01J 11/00
(52) U.S. Cl. ..... 313/112; 313/582
(58) Field of Search ..... 313/582, 584, 313/587, 485, 489, 110, 112; 315/169.4; 445/37, 41, 60

(56) References Cited

U.S. PATENT DOCUMENTS

| | | | | | |
|---|---|---|---|---|---|
| 5,520,855 | A | * | 5/1996 | Ito et al. | 252/582 |
| 5,793,158 | A | * | 8/1998 | Wedding, Sr. | 313/489 |
| 5,818,168 | A | * | 10/1998 | Ushifusa et al. | 313/582 |
| 5,838,105 | A | * | 11/1998 | Mitomo | 313/582 |
| 5,990,619 | A | * | 11/1999 | Ilcisin et al. | 313/584 |
| 6,066,917 | A | * | 5/2000 | Funada | 313/587 |
| 6,229,252 | B1 | * | 5/2001 | Teng et al. | 313/112 |
| 6,297,582 | B1 | * | 10/2001 | Hirota et al. | 313/110 |
| 6,411,032 | B1 | * | 6/2002 | Shiiki et al. | 313/485 |
| 6,559,592 | B1 | * | 5/2003 | Lee | 313/495 |
| 6,630,789 | B2 | * | 10/2003 | Hirota et al. | 313/582 |

FOREIGN PATENT DOCUMENTS

| | | |
|---|---|---|
| EP | 0 939 420 | 9/1999 |
| EP | 0 966 017 | 12/1999 |
| EP | 1 030 340 | 8/2000 |
| EP | 1 041 598 | 10/2000 |
| JP | 11-54047 | 2/1999 |
| JP | 11-67099 | 3/1999 |
| JP | 11-63523 | 6/1999 |
| JP | 11-231301 | 8/1999 |
| JP | 11-306996 | 11/1999 |
| JP | 2000-353474 | 12/2000 |

OTHER PUBLICATIONS

Patent Abstracts of Japan of Publication No. 08123364 dated May 17, 1996.

English Translation of Rejection Communication from the JPO dated Feb. 12, 2004.

* cited by examiner

*Primary Examiner*—Ashok Patel
(74) *Attorney, Agent, or Firm*—Staas & Halsey LLP

(57) ABSTRACT

A gas discharge display device is provided in which an influence of light emission of a discharge gas is reduced so that color reproducibility is improved. The gas discharge display device reproduces a color of each pixel of a color image by controlling light emission quantities of three kinds of cells having different light emission colors. The mixed color of the light emission colors of the three kinds of cells when reproducing a white color is set to a color defined by chromaticity coordinates in which a deviation from a blackbody locus is generated in a chromaticity diagram. A filter is disposed at the front side of the three kinds of cells. The filter has spectral characteristics of converting the mixed color to a color having a higher color temperature and defined by chromaticity coordinates point that is close to the blackbody locus.

7 Claims, 8 Drawing Sheets

GAS DISCHARGE DISPLAY DEVICE

BACKGROUND OF THE INVENTION

1. Field of the Invention

The present invention relates to a gas discharge display device such as a surface discharge type plasma display panel (PDP) utilizing a light emission device.

A PDP has been becoming widespread as a television set having a large screen taking advantage of commercialization of a color display. One of tasks concerning the image quality of a PDP is to enlarge a reproducible color range.

2. Description of the Prior Art

As a conventional color display device, an AC type PDP having a three-electrode surface discharge structure is commercialized. This PDP has a pair of main electrodes arranged in parallel for sustaining of each line (row) of matrix display and an address electrode arranged for each column, so that total three electrodes are used for a cell that is a unit of light emission element. In the surface discharge structure, the main electrode pair is arranged on a first substrate, and a fluorescent material layer for color display is arranged on a second substrate opposing the first substrate. Thus, deterioration of the fluorescent material layer due to the impact of ion upon discharge can be reduced and a long life of PDP can be realized.

In the color display, three cells correspond to each pixel of an image. A display color of each pixel is determined by controlling a light emission quantity of the fluorescent material of each color, i.e., red, green or blue color. Conventionally, the composition of fluorescent materials and the light emission intensity ratio of three colors are selected so that the display color becomes white when the light emission quantity is the maximum in the variable range for each of red, green and blue colors.

It is difficult to prevent the light emission color of a discharge gas from mixing with the light emission color of the fluorescent material in a color display utilizing a gas discharge. The light emission of the discharge gas can deteriorate color reproducibility of a PDP.

FIG. 12 shows a light emission spectrum of a two-component gas containing neon (Ne) and xenon (Xe). An example of a light emission peak of each fluorescent material of red, green and blue colors in a broken line in FIG. 12. As understood from FIG. 12, the light emission peak of the discharge gas is at the vicinity of the maximum light emission peak (585 nm) of the red fluorescent material. This is cased by the neon gas component of the discharge gas. Despite the reproduced color of the fluorescent material, a reddish display is obtained over the entire screen since the red color of the light emission of the neon gas is added. Thus, a color purity of each of the red, green and blue colors is deteriorated. Especially, the display ability of blue color is deteriorated. In addition, the display color of white color pixel may have a low color temperature value compared with the reproduced color of each fluorescent material.

SUMMARY OF THE INVENTION

The object of the present invention is to reduce an influence of the light emission of the discharge gas and to enhance the color reproducibility.

FIG. 1 is a chromaticity diagram showing the relationship between the light emission color and the display color in the present invention. The blackbody locus is drawn by the thin curved line.

In the present invention, a filter is provided for attenuating the light emitted by e.g., the neon gas component of the discharge gas, and a white balance (a ratio of light emission intensities of three colors) of the color reproduction by the fluorescent material is systematically shifted from an "optimum value" to a "particular value" in expectation of the attenuation of the filter. These "optimum value" and "particular value" are important. The "optimum value" is a value that reproduces a color (a pure white color) in the vicinity of chromaticity coordinates on the blackbody locus in the chromaticity diagram. This "optimum value" is preferably set to a value that is a little negative from a point on the blackbody locus (between 0.000 and −0.005 uv as a deviation). The "optimum value" should be set in accordance with a preferable white color (color temperature) that is adapted to a usage of the display device or a region (country) where the display device is used. The "particular value" is a value that reproduces a color defined by the chromaticity coordinates whose deviation from the blackbody locus is positive or negative. In FIG. 1, an example of the optimum value is shown by an open round mark, and the corresponding particular value is shown by a black round mark. The light having the chromaticity of the black round mark generated by the light emission of the three fluorescent materials becomes a display light after passing the filter. The filter absorbs the light within the visible wavelength range corresponding to the gas light emission and changes the value of the display chromaticity coordinates from the chromaticity at the black round mark to the chromaticity at the open round mark. For example, in the case of using the discharge gas having the light emission spectrum shown in FIG. 12, a filter that removes the light emission of the neon gas is used, and the light emission balance among red, green and blue colors is controlled, so that the display color becomes a color having color temperature higher than the light emission color.

The reason the optimum value is set to a value that is a little negative from a point on the blackbody locus (between 0.000 and −0.005 uv as a deviation) will be explained. In the research of improving the display color, the inventor noted the phenomenon that the chromaticity of the white color display changes in accordance with a display load factor. The display load factor means a ratio of a display area (a lighted area) to the entire area that can be used for display. A color display utilizing a gas discharge as shown in FIGS. 13A and 13B has a tendency that the color temperature of the white color decreases along with the increase of the display load factor, and the color temperature deviation quantity increases in the positive direction. The decrease of the color temperature means that the displayed white color becomes yellowish. The increase of the color temperature deviation in the positive direction means that the displayed white color becomes greenish. Since a human visual sense is sensitive to green color, the increase of the deviation in the positive direction from the blackbody locus is sensed as a conspicuous color deviation. Therefore, it is desirable that the white color chromaticity when the display load factor is small (for example, the display load factor is approximately 10%) is set to a value that is a little negative from a point on the blackbody locus (between 0.000 and −0.005 uv as a deviation), and this chromaticity value is set to the optimum value. In this case, if the display load factor increases, the color temperature deviation quantity increases in the positive direction straddling the blackbody locus. Therefore, the deviation quantity from the blackbody locus decreases, so that the color deviation cannot be conspicuous for a human visual sense.

As explained above, selection of the light emission color and the adoption of the filter selecting a wavelength can improve the display color. However, it is difficult to remove only the light emission color of the discharge gas by the filter. It is because the light emission spectrum of the neon gas has a wavelength that is close to that of the light emission spectrum of the red fluorescent material as shown in FIG. 12. Therefore, the light emitted by the fluorescent material can be attenuated by the filter to some extent. In order to improve this, the light quantity emitted by the fluorescent material should be increased for compensating the attenuation by the filter. For example, in the case of providing a filter for removing the light emission by the neon gas, the red light emission quantity is set large compared with other green and blue fluorescent materials. The light emission quantity of the fluorescent material can be set large by adopting a material having a high light emission luminance, or by changing the element structure so as to increase the discharge intensity or the light emission area.

According to a first aspect of the present invention, a gas discharge display device is provided that reproduces a color of each pixel of a color image by controlling light emission quantities of three kinds of cells having different light emission colors. In the gas discharge display device, a mixed color of the light emission colors of the three kinds of cells when reproducing a white color is set to a color defined by chromaticity coordinates in which a positive or negative deviation from a blackbody locus is generated in a chromaticity diagram, and a filter is disposed at the front side of the three kinds of cells, the filter having spectral characteristics of converting the mixed color to a color having a higher color temperature and defined by chromaticity coordinates that is close to the blackbody locus.

According to a second aspect of the present invention, a first kind of cell includes a fluorescent material emitting a red light, a second kind of cell includes a fluorescent material emitting a green color, and a third kind of cell includes a fluorescent material emitting a blue color.

According to a third aspect of the present invention, the structure conditions of the three kinds of cells are systematically set to uneven conditions.

According to a fourth aspect of the present invention, the structure conditions are effective areas of the electrodes for generating gas discharge.

According to a fifth aspect of the present invention, the three kinds of cells have fluorescent materials that distinguish light emission colors thereof, and the structure conditions are light emission areas of the fluorescent materials.

According to a sixth aspect of the present invention, the structure conditions are thickness values of the dielectric layers that cover electrodes for generating gas discharge.

According to a seventh aspect of the present invention, the filter has the wavelength selective absorption characteristics in which a wavelength having the minimum transmittance in the visible wavelength range is a value within the range between 560 and 610 nanometers.

DESCRIPTION OF THF PREFERRED EMBODIMENTS

Hereinafter, the present invention will be explained in detail with reference to embodiments and accompanied drawings.

Figure 1:
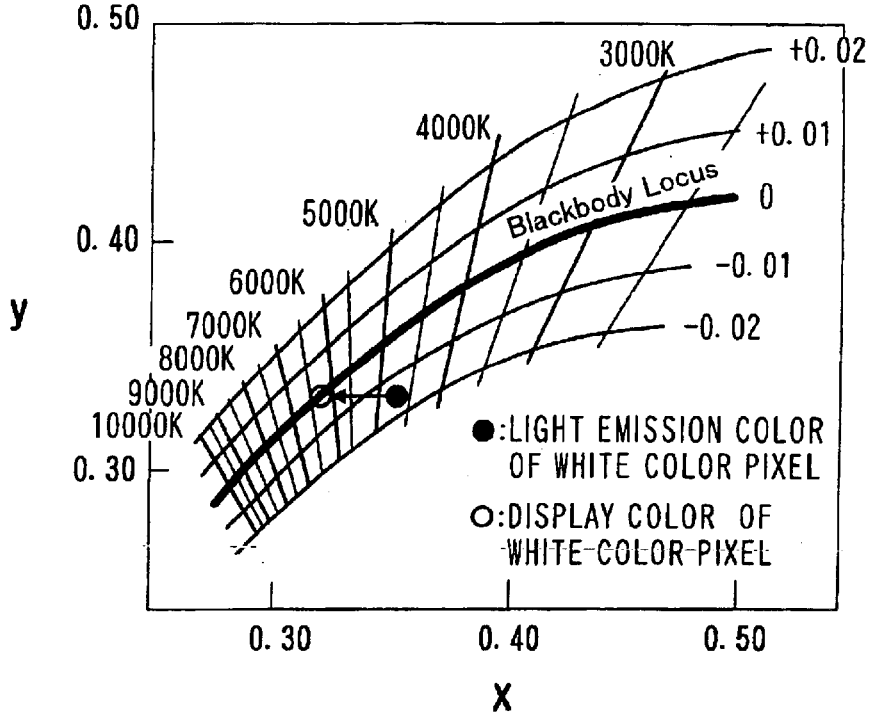
FIG. 1 is a chromaticity diagram showing the relationship between the light emission color and the display color in the present invention.
Figure 2:
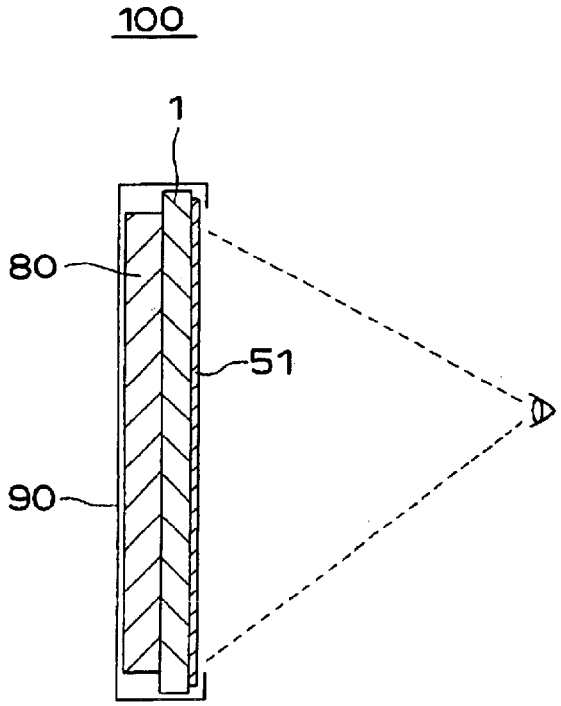
FIG. 2 shows a structure of a display device according to the present invention.
Figure 3:
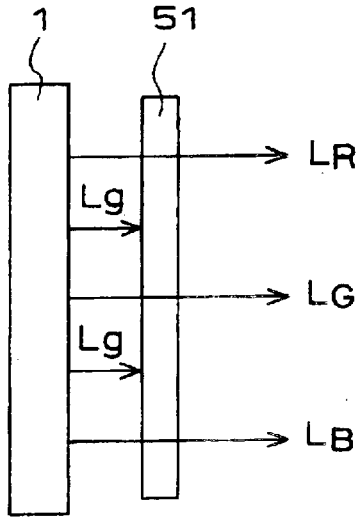
FIG. 3 is a schematic diagram of a filter function.

FIG. 2 shows a structure of a display device according to the present invention. FIG. 3 is a schematic diagram of a filter function. A display device 100 shown in FIG. 2 includes a PDP 1 that is a color display device, a filter 51 that is attached to the front face of the PDP 1 intimately or with a gap between them, a driving unit 80 for lighting each cell of the PDP 1 in accordance with the contents of display, and an outer cover 90. As shown in FIG. 3, PDP 1 emits red, green and blue lights LR, LG, LB by light emission of the fluorescent material and the light Lg by light emission of the discharge gas. The filter 51 has an area that covers the entire display surface, and its optical characteristic is designed to attenuate the light Lg selectively. The filter 51 is preferably a filter utilizing light absorption of a pigment.

Figure 4:
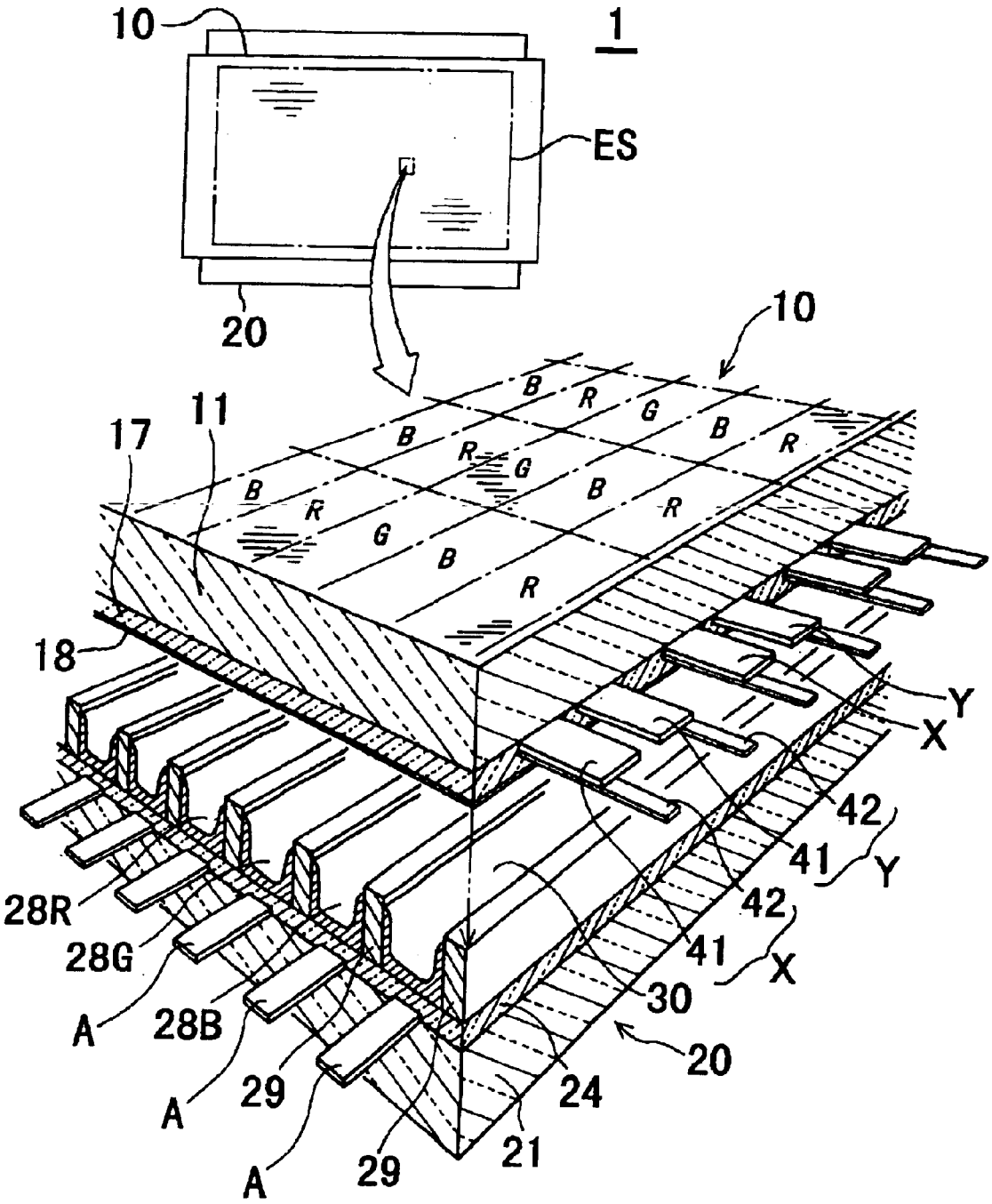
FIG. 4 is an exploded perspective view showing a basic structure inside a first PDP.

FIG. 4 is an exploded perspective view showing a basic structure inside a PDP.

The PDP 1 is a three-electrode surface discharge structure PDP that has first and second main electrodes X, Y that are arranged in parallel and constitute an electrode pair for generating a sustaining discharge, and an address electrode A as a third electrode that crosses the main electrodes X, Y in each cell (each display element). The main electrodes X, Y extend in the row direction (the horizontal direction) of the screen, and the second main electrode Y is used as a scanning electrode for selecting cells on a row in the addressing. The address electrode A extends in the column direction (the vertical direction) and is used as a data electrode for selecting cell on a column. The area where the main electrodes and the address electrodes cross in the substrate surface is the display surface ES.

Figure 12:
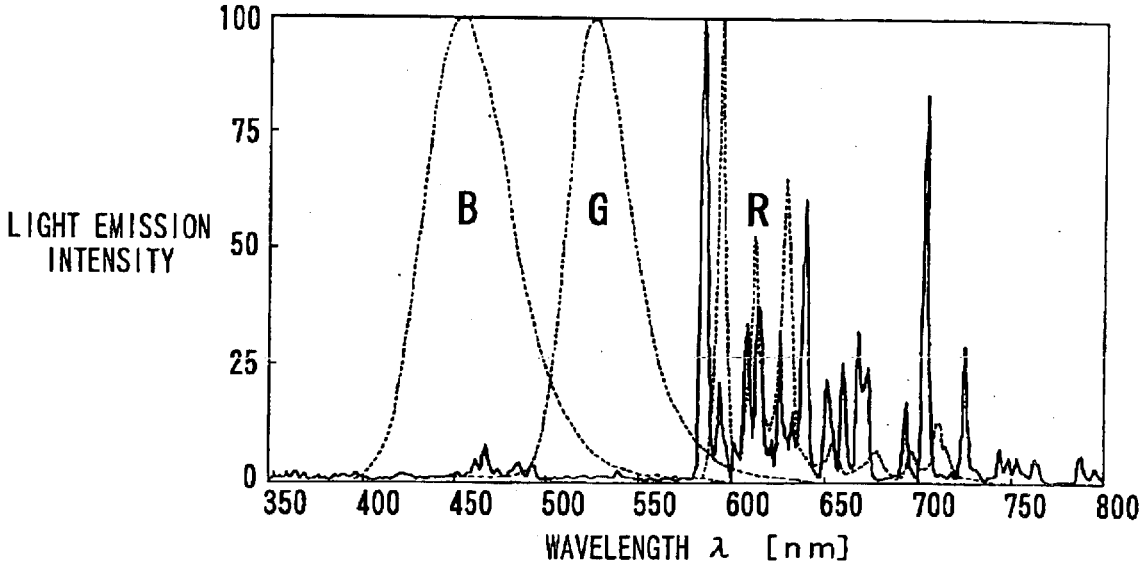
Prior Art FIG. 12
FIG. 12 shows a light emission spectrum of a two-component gas containing neon and a xenon.
Figure 13A:
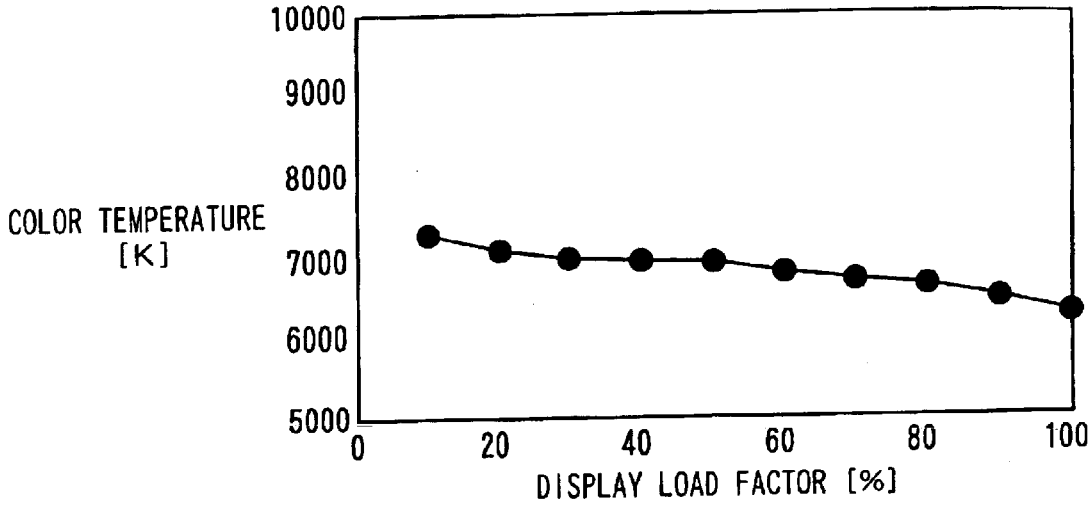
FIGS. 13A and 13B show relationship between the display load factor and the color temperature.
Figure 13B:
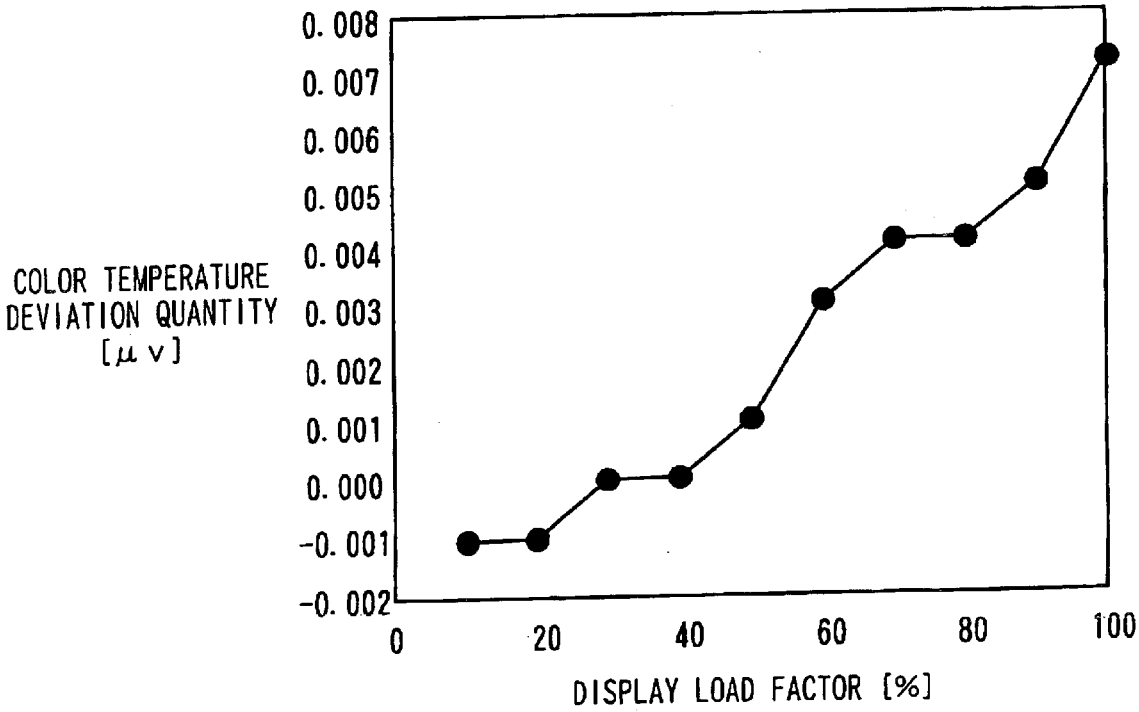

In the PDP 1, a pair of main electrodes X, Y is arranged for each row on the inner surface of the glass substrate 11 that constitutes the front substrate structure. The row is made of plural cells aligned in the horizontal direction of the screen. Each of the main electrodes X, Y includes a transparent conductive film 41 and a metal film (a bus conductor) 42, which are covered with a dielectric layer 17 made of a low melting point glass having the thickness of approximately 30 $\mu$m. The surface of the dielectric layer 17 is covered with a protection film 18 made of a magnesia (MgO) having the thickness of several thousands of angstroms. The address electrodes A are arranged on the inner surface of the glass substrate 21 that constitutes the rear substrate structure and are covered with a dielectric layer 24 having the thickness of approximately 10 μm. On the dielectric layer 24, a partition 29 having the height of 150 μm and the linear band-like shape from the top view is provided at each space between the address electrodes A. The partitions 29 divide the discharge space 30 in the row direction for each subpixel (each unit of light emission area), and the gap size of the discharge space 30 is defined. The discharge space 30 is filled with the discharge gas containing neon (Ne) as a main component and xenon (Xe). Covering the inner surface of the rear side including the upper of the address electrode A and the side face of the partition 29, fluorescent material layers 28R, 28G and 28B are provided for color display of red, green and blue colors. The fluorescent material layers 28R, 28G and 28B are excited locally by ultraviolet rays emitted by the xenon upon discharge and emit light rays. A preferable example of the fluorescent material is shown in Table 1. In the following explanation, Penning gas of Ne—Xe (4%) composition having the light emission spectrum distribution as shown in FIG. 12 is used as the discharge gas.

TABLE 1

| light emission color | fluorescent material |
|---|---|
| red | (Y, Gd) $BO_3$:Eu |
| green | $Zn_2SiO_4$:Mn |
| blue | $BaMgAl_{10}O_{17}$:Eu |

One pixel of the display is made of three subpixels that are aligned in the row direction and have three different light emission colors. The structure in the subpixel is a cell (a display element). Since the arrangement pattern of the partition 29 is a stripe pattern, the portion of the discharge space 30 corresponding to each column is continuous in the column direction over all rows. The electrode gap between the neighboring rows is set to a value that is sufficiently larger than the surface discharge gap (e.g., a value within the range of 80–140 μm) and can prevent the discharge connection in the column direction (e.g., a value within the range of 400–500 μm). The address discharge is generated between the main electrode Y and the address electrode A for the cells to be lighted (in a writing address format) or the cells not to be lighted (in an erasing address format), so that an appropriate quantity of wall charge is formed in only the cells to be lighted for each row. Then, a sustaining voltage Vs is applied between the main electrodes X, Y, so that a surface discharge is generated along the substrate surface in the cells to be lighted.

As explained above, In the conventional technology, when performing color display by a PDP, the composition of the fluorescent materials and the light emission intensity ratio of three colors are selected so that the display color becomes white when the light emission quantity of red, green and blue fluorescent material layers are set to the maximum value of each variable range of the signal intensity. In the selection of the light emission intensity ratio, fluorescent materials that are available regarding a light emission luminance, a display chromaticity, a life or other factors should be used for study. However, there are few fluorescent materials that satisfy the above-mentioned characteristics. Especially, the blue fluorescent has a problem that the luminance is lower than other color fluorescent materials. For this reason, the light emission luminance of the blue fluorescent material is used as a reference, and the light emission luminance values of red and green fluorescent materials are adjusted (decreased) for determining the chromaticity coordinates of the white color and the color temperature value. In the PDP adapted to this method, when using a filter having the visible light average transmittance of 67% under the condition of the ambient illumination of 300 lux, the characteristics values are obtained, which include the white display luminance of 250 cd/$m^2$, the color temperature 9400 K, the color temperature deviation quantity of −0.005 uv and the bright room contrast of 18.

In contrast, the present invention uses a filter for removing the light emission of the neon gas, so that the red color due to the neon gas light emission is eliminated, and the emission balance among the red, green and blue lights is controlled. Thus, the chromaticity coordinates of the white color and the color temperature value can be determined.

In accordance with the present invention, the ratio of the maximum light emission luminance values of red, green and blue cells concerning the color reproduction of the one pixel is set to the above-mentioned particular value. In the PDP 1, the ratio of the light emission luminance is set by selecting the light emission quantities of the fluorescent material layers 28R, 28G and 28B.

Figure 5:
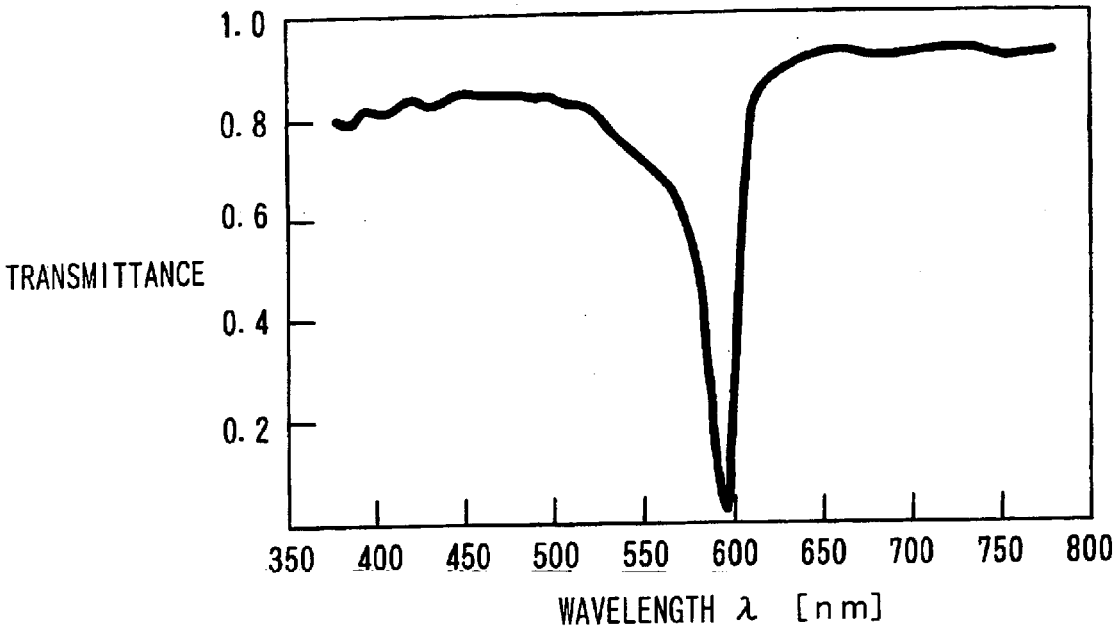
FIG. 5 shows characteristics of a filter of a first example.
Figure 6:
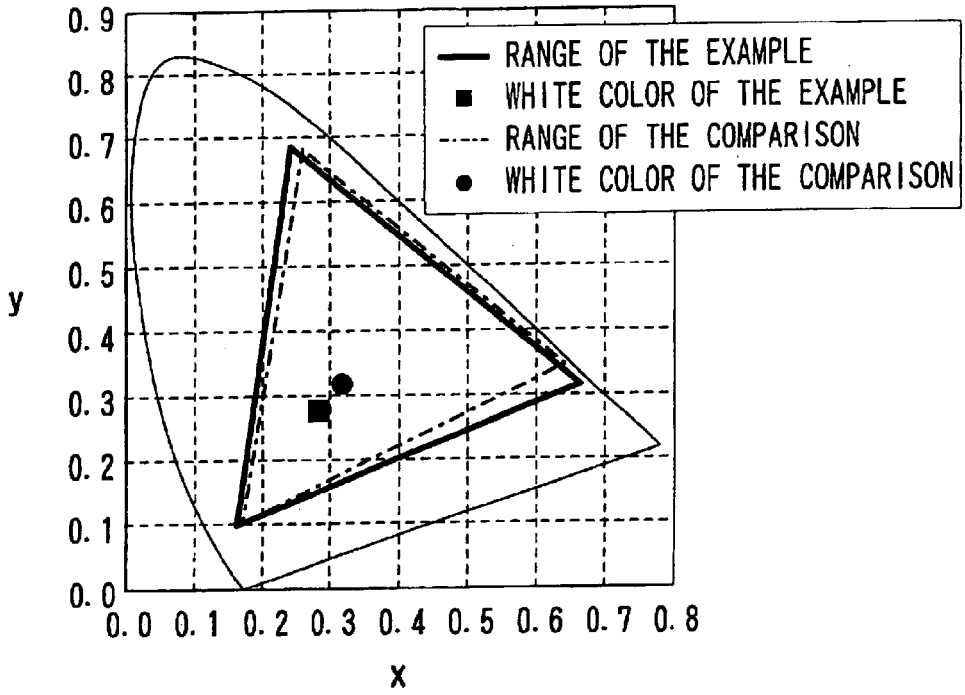
FIG. 6 shows the enlargement of the color reproduction range by applying the first example.

First, the case where the particular value is set to the chromaticity in which the deviation from the blackbody locus becomes negative will be explained. FIG. 5 shows characteristics of a filter of a first example. FIG. 6 shows the enlargement of the color reproduction range by applying the first example.

In the first example, the light emission luminance of the red fluorescent material is adjusted to be 1.5 times the above-mentioned conventional example, and the light emission luminance of the green fluorescent material is adjusted to be 1.3 times the above-mentioned conventional example. The particular value includes the color temperature of 6250 K and the color temperature deviation quantity of −0.001 uv. The PDP 1 having this particular value is provided with a filter 51 having the visible light transparency characteristics with an absorption peak in a wavelength range (560–610 nm) including the maximum light emission wavelength (585 nm) of the neon gas as shown in FIG. 5. Thus, the optimum value of the color temperature 9900 K and the color temperature deviation quantity −0.001 uv can be realized. In addition, under the condition of the ambient illumination of 300 lux, the display characteristics including the white display luminance of 320 cd/$m^2$ and the bright room contrast of 22 are obtained. In FIG. 6, the color reproduction range of the display device 100 is shown by the thick full line, and a comparison example of the color reproduction range in the conventional technology is shown by the chain line. In addition, the black rectangular mark in FIG. 6 indicates the white color displayed by applying the present invention, and the black round mark indicates the white color displayed by the conventional technology. The present invention can enlarge the color reproduction range (the area surrounded by the triangle shown in FIG. 6) to 1.26 times the conventional structure.

Figure 7:
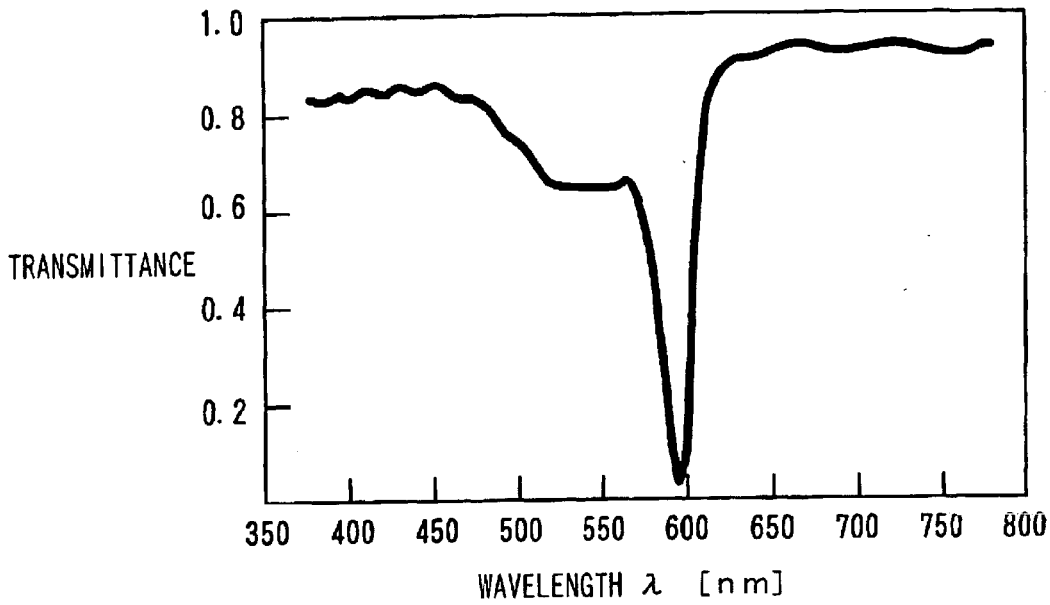
FIG. 7 shows characteristics of a filter according to a second example.
Figure 8:
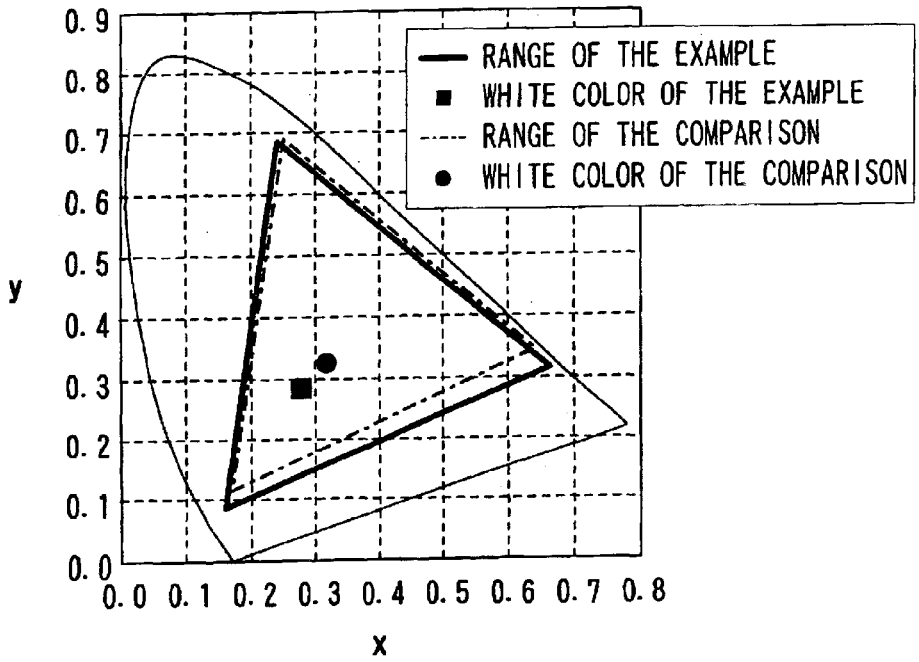
FIG. 8 shows the enlargement of the color reproduction range by the application of the second example.

Next, the case where the particular value is set to a chromaticity so that the deviation from the blackbody locus becomes positive will be explained. FIG. 7 shows characteristics of a filter according to a second example. FIG. 8 shows enlargement of the color reproduction range by the application of the second example.

In the second example, the light emission luminance of the red fluorescent material is adjusted to be 1.5 times the above-mentioned conventional example, and the light emission luminance of the green fluorescent material is adjusted to be 1.3 times the above-mentioned conventional example. The particular value includes the color temperature of 6300 K and the color temperature deviation quantity of +0.002 uv. The PDP 1 having this particular value is provided with a filter as shown in FIG. 7 according to the present invention, so that the optimum value including the color temperature of 9400 K and the color temperature deviation quantity of −0.004 uv can be realized. In addition, under the condition of the ambient illumination of 300 lux, the display characteristics including the white display luminance of 320 cd/$m^2$ and the bright room contrast of 27 are obtained. In FIG. 8, it is clear that the present example can enlarge the color reproduction range to the 1.26 times the conventional example.

As explained above, according to the present invention, the color reproducibility of the display device using a PDP can be improved, and the display luminance as well as the bright room contrast value can be improved compared with the conventional technology. Concerning the polarity (positive or negative) of the deviation from the blackbody locus in which the particular value is set, it is considered what is important for the display device using a PDP among the display characteristics (e.g., the display luminance, the bright room contrast value and the life).

The filter 51 should be disposed at the front side of the discharge space 30. There are various options of the arrangement of the filter 51. However, it is desirable that the filter 51 is disposed at the outer side of the glass substrate 11 of the PDP 1 from the viewpoint of the material selection and the production process. It can be formed on the outer surface of the glass substrate 11 directly or can be formed on the protection plate disposed in front of the glass substrate 11. If another substrate is added to the glass substrate 11 or the protection plate for forming the layer having the above-mentioned characteristics so as to make the filter 51, the substrate can be a glass, an acrylic resin, a polycarbonate resin or a polymer film. For example, an appropriate dye is dispersed in a surface of a polymer film so as to make the transmittance characteristics, and the obtained film filter is affixed to the glass substrate 11 or the protection plate. The dye for attenuating the light within the light emission wavelength range of the discharge gas can include a 1-Ethyl-4-[(1-ethyl-4(1 H)-quinolinylidene)methyl]quinolinium iodide (Kabushikigaisha Nippon Kanko Shikiso Kenkyusho, product No. NK-6) having the absorption peak (absorption maximum) of 590 nm or a 3-Ethyl-2-[3-(1-ethyl-4(1H)-quinolinylidene)-1-propenyl] benzoxazolium iodide (Kabushikigaisha Nippon Kanko Shikiso Kenkyusho, product No. NK-741) having the absorption peak of 594 nm. The Quantities of these dyes and other dyes are adjusted so that desired characteristics can be realized.

In the PDP 1 of the above-mentioned embodiment, the light emission intensity ratio among the red, green and blue colors is adjusted under the condition of the same cell structure for the red, green and blue colors. In the following embodiment, the light emission intensity ratio among the red, green and blue colors is adjusted by changing the cell structures of them. In the following explanation, the cell structures are changed so that the deviation of the particular value from the blackbody locus becomes negative.

Figure 9:
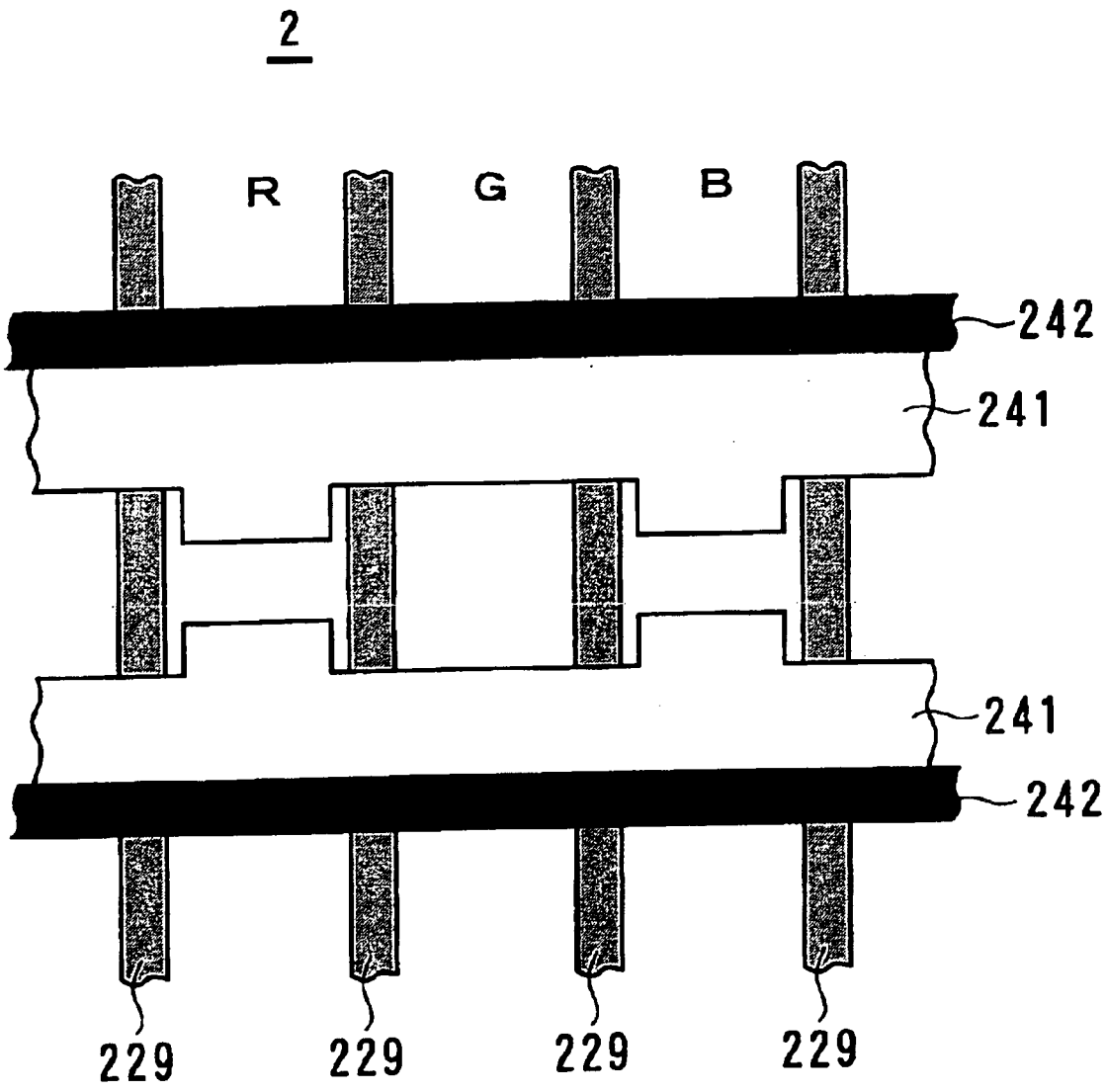
FIG. 9 is a plan view showing an electrode structure of a second PDP.

FIG. 9 is a plan view showing an electrode structure of a second PDP.

The PDP 2 is also the three-electrode surface discharge type, whose basic structure is the same as the PDP 1. Between the partitions 229 arranged in a stripe shape, a fluorescent material layer (not shown) is arranged, so that the three cells aligned in the direction of the partition constitute one pixel. In the PDP 2, the transparent conductive film 241 and the metal film 242 constitute the main electrode, and the width of the transparent conductive film 241 is not uniform. Namely, the transparent conductive film 241 hangs over the surface discharge gap side in the red and blue cells and is formed wide partly. Thus, the electrode areas of the red and blue cells become greater than the green cell, and the light emission quantity of the green cell is weakened compared with the conventional structure in which the luminance ration among red, green and blue is the white color reproducing value that is a display target.

Figure 10:
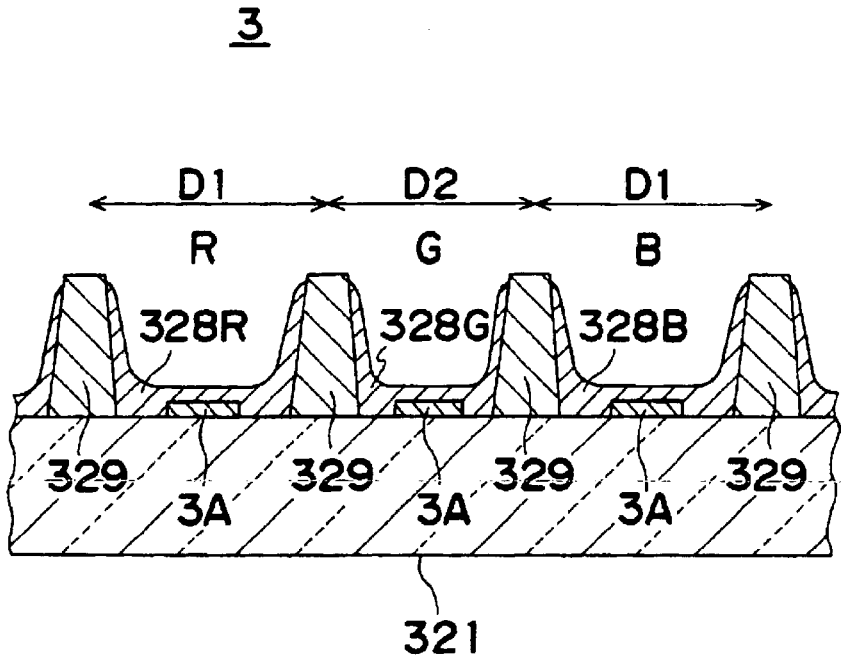
FIG. 10 is a cross section of a principal portion of a third PDP.

FIG. 10 is a cross section of a principal portion of a third PDP.

On the rear side glass substrate 321, address electrodes 3A and partitions 329 are arranged. Fluorescent material layers 328R, 328G and 328B are formed between the partitions. In PDP 3, the dimension D1 of the red and the blue cells in the row direction is longer than the dimension D2 of the green cell. In other words, the green light emission area is smaller than the red and blue light emission areas. Therefore, the light emission quantity of the green cell is smaller than the conventional example.

Figure 11:
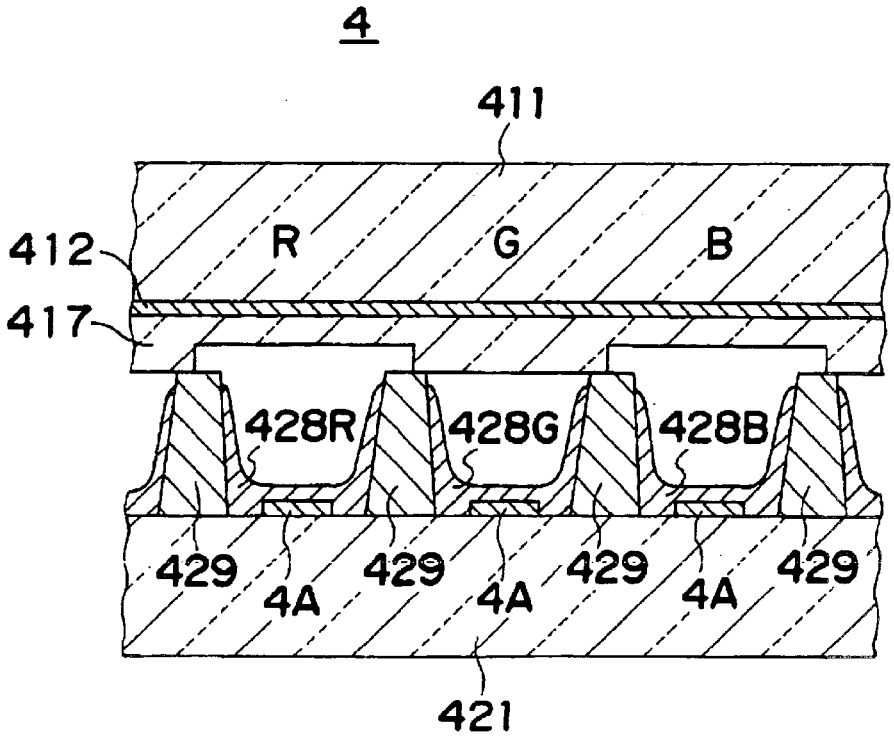
FIG. 11 is a cross section of a principal portion of a fourth PDP.

FIG. 11 is a cross section of a principal portion of a fourth PDP.

On the inner surface of the front side glass substrate 411, main electrodes 412 and a dielectric layer 417 are provided. On the rear side glass substrate 421, address electrodes 4A and partitions 429 are arranged. Fluorescent material layers 428R, 428G and 428B are formed between the partitions. In PDP 4, the portions of the dielectric layer 417 corresponding to the red and blue cells are thinner than the portion corresponding to the green cell. Thus, the light emission quantity of the green cell becomes smaller than the conventional structure.

The light emission intensity ratio among the red, green and blue colors is adjusted appropriately using the cell structure, so that the effect of the present invention is obtained in the same way as the case where the cell structure is the same for three colors explained above.

If a discharge gas except the Ne—Xe Penning gas is used, the filter characteristics are set so as to eliminate the light emission color of the discharge gas and to set the light emission intensity of each color appropriately to meet the spectral characteristics of the filter.

According to the present invention, a gas discharge display device can be provided in which the influence of the light emission of the discharge gas can be reduced, and the color reproducibility is increased. In addition, the display device with high quality can display the image in a white color having a color temperature value desirable for a display device.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A gas discharge display device that reproduces a color of each pixel of a color image by controlling light emission quantities of three kinds of cells having different light emission colors, the device comprising:

a discharge gas sealed in the three kinds of cells;

a first fluorescent material in a first of the three kinds of cells emitting a red light;

a second fluorescent material in a second of the three kinds of cells emitting a green light;

a third fluorescent material in a third of the three kinds of cells emitting a blue light;

a filter located at a front side of the three kinds of cells; and a first mixed color of the respective light emissions of the first fluorescent material, the second fluorescent material and the third fluorescent material, when reproducing a white color, being a color defined by first chromaticity coordinates in which a deviation from a blackbody locus is generated in a chromaticity diagram and a second mixed color of the first mixed color and a light emission color of the discharge gas, when reproducing a white color, being a color defined by second chromaticity coordinates in which a deviation from the blackbody locus is generated in the chromaticity diagram, wherein the filter converts the second mixed color into a color having a higher color temperature than the second mixed color, defined by third chromaticity coordinates that are closer to the blackbody locus than the second chromaticity coordinates of the second mixed color and in which a negative deviation from the blackbody locus is generated.

2. The gas discharge display device according to claim 1, wherein a first kind of cell includes a fluorescent material emitting a red light, a second kind of cell includes a fluorescent material emitting a green color, and a third kind of cell includes a fluorescent material emitting a blue color.

3. The gas discharge display device according to claim 1, wherein the structure conditions of the three kinds of cells are systematically set to uneven conditions.

4. The gas discharge display device according to claim 1, wherein the filter has wavelength selective absorption characteristics in which a wavelength, having a minimum transmittance in the visible wavelength range, is a value within a range between 560 and 610 nanometers.

5. A gas discharge display device that reproduces a color of each pixel of a color image by controlling respective light emission quantities of three kinds of cells having different light emission colors, the device comprising:

a discharge gas sealed in the three kinds of cells, the discharge gas containing neon as a main component;

a first fluorescent material in a first of the three kinds of cells emitting a red light;

a second fluorescent material In a second of the three kinds of cells emitting a green light;

a third fluorescent material in a third of the three kinds of cells emitting a blue light;

a filter having wavelength selective absorption characteristics in which a wavelength, having a minimum transmittance in the visible wavelength range, is a value within a range between 560 and 610 nanometers, the filter being located at a front side of the three kinds of cells;

an effective area of an electrode for generating gas discharges in the second kind of cells, being smaller than effective areas of electrodes for generating gas discharges in the first and third kinds of cells; and a first mixed color of the respective light emissions of the first fluorescent material, the second fluorescent material and the third fluorescent material, when reproducing a white color, being a color defined by first chromaticity coordinates in which a deviation from a blackbody locus is generated in a chromaticity diagram and a second mixed color of the first mixed color and a light emission color of the discharge gas, when reproducing a white color, being a color defined by second chromaticity coordinates in which a deviation from the blackbody locus is generated in the chromaticity diagram, wherein the filter converts the second mixed color into a color having a higher color temperature than the second mixed color, defined by third chromaticity coordinates that are closer to the blackbody locus than the second chromaticity coordinates of the second mixed color and in which a negative deviation from the blackbody locus is generated.

6. A gas discharge display device that reproduces a color of each pixel of a color image by controlling respective light emission quantities of three kinds of cells having different light emission colors, the device comprising:

a discharge gas sealed in the three kinds of cells, the discharge gas containing neon as a main component;

a first fluorescent material in a first of the three kinds of cells emitting a red light;

a second fluorescent material in a second of the three kinds of cells emitting a green light;

a third fluorescent material in a third of the three kinds of cells emitting a blue light;

a filter having wavelength selective absorption characteristics in which a wavelength, having a minimum transmittance in the visible wavelength range, is a value within a range between 560 and 610 nanometers, the filter being located at a front side of the three kinds of cells;

a light emission area of the second fluorescent material being smaller than light emission areas of the first and third fluorescent materials in the respective three kinds of cells; and a first mixed color of the respective light emissions of the first fluorescent material, the second fluorescent material and the third fluorescent material, when reproducing a white color, being a color defined by first chromaticity coordinates in which a deviation from a blackbody locus is generated in a chromaticity diagram and a second mixed color of the first mixed color and a light emission color of the discharge gas, when reproducing a white color, being a color defined by second chromaticity coordinates in which a deviation from the blackbody locus is generated in the chromaticity diagram, wherein the filter converts the second mixed color into a color having a higher color temperature than the second mixed color, defined by third chromaticity coordinates that are closer to the blackbody locus than the second chromaticity coordinates of the second mixed color and in which a negative deviation from the blackbody locus is generated.

7. A gas discharge display device that reproduces a color of each pixel of a color image by controlling respective light emission quantities of three kinds of cells having different light emission colors, the device comprising:

a discharge gas sealed in the three kinds of cells, the discharge gas containing neon as a main component;

a first fluorescent material in a first of the three kinds of cells emitting a red light;

a second fluorescent material in a second of the three kinds of cells emitting a green light;

a third fluorescent material in a third of the three kinds of cells emitting a blue light;

a filter having wavelength selective absorption characteristics in which a wavelength, having a minimum transmittance in the visible wavelength range, is a value within a range between 560 and 610 nanometers, the filter being located at a front side of the three kinds of cells;

a dielectric layer, covering an electrode which generates gas discharges in the second kind of cell, the dielectric layer being larger than dielectric layers covering electrodes which generate gas discharges in the first and third kinds of cells; and a first mixed color of the respective light emissions of the first fluorescent material, the second fluorescent material and the third fluorescent material, when reproducing a white color, being a color defined by first chromaticity coordinates in which a deviation from a blackbody locus is generated in a chromaticity diagram and a second mixed color of the first mixed color and a light emission color of the discharge gas, when reproducing a white color, being a color defined by second chromaticity coordinates in which a deviation from the blackbody locus is generated in the chromaticity diagram, wherein the filter converts the second mixed color into a color having a higher color temperature than the second mixed color, defined by third chromaticity coordinates that are closer to the blackbody locus than the second chromaticity coordinates of the second mixed color and in which a negative deviation from the blackbody locus is generated.

* * * * *

UNITED STATES PATENT AND TRADEMARK OFFICE

CERTIFICATE OF CORRECTION

PATENT NO. : 6,909,225 B1
APPLICATION NO. : 09/722697
DATED : June 21, 2005
INVENTOR(S) : Katsuya Irie et al.

It is certified that error appears in the above-identified patent and that said Letters Patent is hereby corrected as shown below:

Column 9, line 47, after “material” change “In” to --in--;

Column 12, after claim 7, insert claim 8 as follows:

A gas discharge display device that reproduces a color of each pixel of a color image by controlling respective light emission quantities of three kinds of cells having different light emission colors, the device comprising:

a discharge gas sealed in the three kinds of calls;

a first fluorescent material in a first of the three kinds of cells emitting a red light;

a second fluorescent material in a second of the three kinds of cells emitting a green light;

a third fluorescent material in a third of the three kinds of cells emitting a blue light;

a filter located at a front side of the three kinds of cells;

a first mixed color of the respective light emissions of the first fluorescent material, the second fluorescent material and the third fluorescent material, when reproducing a white color under a condition of a display load factor at 10%, being a color defined by first chromaticity coordinates in which a deviation from a blackbody locus is generated in a chromaticity diagram and a second mixed color of the first mixed color and a light emission color of the discharge gas, when reproducing a white color under a condition of a display load factor at 10%, being a color defined by second chromaticity coordinates in which a deviation from the blackbody locus is generated in the chromaticity diagram; and

UNITED STATES PATENT AND TRADEMARK OFFICE

CERTIFICATE OF CORRECTION

PATENT NO. : 6,909,225 B1
APPLICATION NO. : 09/722697
DATED : June 21, 2005
INVENTOR(S) : Katsuya Irie et al.

It is certified that error appears in the above-identified patent and that said Letters Patent is hereby corrected as shown below:

the filter converts the second mixed color into a color having a higher color temperature than the second mixed color, defined by third chromaticity coordinates that are closer to the blackbody locus than the second chromaticity coordinates of the second mixed color and in which a negative deviation from the blackbody locus is generated.

Signed and Sealed this

Tenth Day of October, 2006

JON W. DUDAS
*Director of the United States Patent and Trademark Office*